US007191744B2

(12) United States Patent
Minato

(10) Patent No.: US 7,191,744 B2
(45) Date of Patent: Mar. 20, 2007

(54) EXHAUST VALVE DRIVE CONTROL METHOD AND DEVICE

(75) Inventor: Akihiko Minato, Fujisawa (JP)

(73) Assignee: Isuzu Motors Limited, Tokyo (JP)

( * ) Notice: Subject to any disclaimer, the term of this patent is extended or adjusted under 35 U.S.C. 154(b) by 68 days.

(21) Appl. No.: 11/154,415

(22) Filed: Jun. 15, 2005

(65) Prior Publication Data

US 2005/0283301 A1 Dec. 22, 2005

(30) Foreign Application Priority Data

Jun. 17, 2004 (JP) ..... 2004-179699

(51) Int. Cl.
*F01L 9/02* (2006.01)

(52) U.S. Cl. ..... 123/90.12; 123/90.15; 123/90.16

(58) Field of Classification Search ..... 123/90.12, 123/90.15, 90.16, 90.11, 90.17
See application file for complete search history.

(56) References Cited

U.S. PATENT DOCUMENTS

| | | | | |
|---|---|---|---|---|
| 6,092,495 | A * | 7/2000 | Hackett | 123/90.15 |
| 2002/0157650 | A1 | 10/2002 | Gaessler et al. | 123/490 |
| 2004/0003787 | A1 | 1/2004 | Allen | 123/90.12 |

FOREIGN PATENT DOCUMENTS

| | | |
|---|---|---|
| EP | 1 260 680 A2 | 11/2002 |
| JP | 2001-280109 | 10/2001 |
| JP | 2001280109 | 10/2001 |
| JP | 2003-328713 | 11/2003 |

OTHER PUBLICATIONS

European Search Report for Serial No. EP 05 01 2548 dated Nov. 23, 2006.

* cited by examiner

*Primary Examiner*—Thomas Denion
*Assistant Examiner*—Zelalem Eshete
(74) *Attorney, Agent, or Firm*—McCormick, Paulding & Huber LLP

(57) ABSTRACT

The present invention provides a method for controlling a closing operation of an exhaust valve (11) in an internal combustion engine. A current position $X_0$ of the exhaust valve (11) and a rotation speed Ne of the internal combustion engine are determined, and on the basis of the current position $X_0$ and rotation speed Ne, a time $T_0$ at which a piston arrives at the current position $X_0$ of the exhaust valve (11) is calculated. The closing operation of the exhaust valve (11) is then started before this arrival time $T_0$. Next, a time $T_1$ at which the gap between the exhaust valve (11) and piston reaches a first predetermined value hc1 is calculated, and when this time $T_1$ arrives, the closing operation of the exhaust valve (11) is stopped temporarily. A time $T_2$ at which the piston arrives at the stopping position $X_1$ of the exhaust valve (11) is then calculated, and the closing operation of the exhaust valve (11) is resumed before this arrival time $T_2$.

14 Claims, 6 Drawing Sheets

EXHAUST VALVE DRIVE CONTROL METHOD AND DEVICE

CROSS REFERENCE TO RELATED APPLICATION

The applicant hereby claims foreign priority benefits under U.S.C. § 119 of Japanese Patent Application No. 2004-179699 filed on Jun. 17, 2004, and the content of which is herein incorporated by reference.

BACKGROUND OF THE INVENTION

1. Field of the Invention

The present invention relates to a method and device for controlling the driving of an exhaust valve in an internal combustion engine, and more particularly to an exhaust valve drive control method and device in which a closing operation of the exhaust valve can be modeled easily such that the exhaust valve is controlled to close on the basis of this model.

2. Description of the Related Art

In recent years, valve mechanisms which drive a valve to open and close using fluid pressure rather than a cam mechanism have been proposed (see Japanese Unexamined Patent Application Publication 2003-328713 and Japanese Unexamined Patent Application Publication 2001-280109, for example) in order to enhance the freedom with which an exhaust valve and intake valve of an internal combustion engine ("engine" hereafter) are controlled to open and close. When such a valve mechanism is used, the open/close timing, displacement, and so on of the exhaust valve and intake valve can be adjusted and controlled in accordance with the operating conditions of the engine, thereby enabling finer engine control. Particularly when the exhaust valve is controlled to close, scavenging can be performed reliably and effectively while avoiding contact between the exhaust valve and a rising piston.

For example, the present applicant proposes valve closing control such as that shown in FIG. 7.

A line A in the drawing denotes the displacement of the exhaust valve (the position of the lower end of the exhaust valve), and a line B denotes a piston position (the position of the upper end of the piston). The lower end of the ordinate shows the position of the exhaust valve when fully closed (displacement zero). Moving upward steadily along the ordinate, the displacement (opening) of the exhaust valve increases and the piston position falls. In other words, in FIG. 7 the positional relationship and traveling direction of the exhaust valve and the piston are illustrated upside-down from the actual positional relationship and traveling direction.

FIG. 7A shows an example in which the engine rotation speed is comparatively low, and the piston rising speed is lower than the exhaust valve closing speed (rising speed).

As shown in the drawing, the exhaust valve closing operation begins before the piston rises to the lower end of the fully open exhaust valve. Here, the rising speed of the piston is lower than the closing speed of the exhaust valve, and hence when the exhaust valve closing operation begins, the gap between the piston and the exhaust valve increases gradually. Once the gap between the piston and exhaust valve has increased to a predetermined value, the exhaust valve closing operation is halted temporarily. Then, when the gap between the rising piston and the exhaust valve closes to a certain extent, the closing operation is resumed. In other words, the exhaust valve closing operation is executed in stages according to the rising of the piston. By closing the exhaust valve in stages in this manner, a sufficient opening area can be secured for the exhaust outlet, and hence the scavenging efficiency can be improved.

However, the rising speed of the piston naturally varies according to the engine rotation speed, and therefore the content of the exhaust valve closing control must be modified for every engine rotation speed.

For example, in a region in which the piston rising speed is greater than the exhaust valve closing speed, the piston may contact the exhaust valve if the exhaust valve is closed in stages, and hence, as shown in FIG. 7B, the exhaust valve must be closed continuously (in one operation) from the fully open position to the fully closed position. In this case, the exhaust valve is driven once, and the driving period is comparatively long. Note that the valve closing control shown in FIG. 7 was an unpublished technique at the time of the filing (Jun. 17, 2004) of the Japanese Patent Application from which this application claims priority, and does not constitute prior art.

Since the content of the optimum closing control for the exhaust valve (the number of times the valve is driven, the driving timing, the driving period, and so on) differs according to the engine rotation speed in this manner, control maps defining the optimum control content for each engine rotation speed are created conventionally, but since a large number of control maps is required, an extremely large amount of labor is involved in creating the maps.

SUMMARY OF THE INVENTION

An object of the present invention is to solve the problems described above by providing an exhaust valve drive control method and device which are capable of performing exhaust valve closing control in accordance with the engine rotation speed without the need for a large number of control maps.

An aspect of the present invention, conceived in order to achieve this object, is a method of controlling a closing operation of an exhaust valve in an internal combustion engine, comprising the steps of first determining the current position of the exhaust valve and the rotation speed of the internal combustion engine, and then calculating a time at which a piston arrives at the current position of the exhaust valve on the basis of the determined current position and rotation speed; starting the closing operation of the exhaust valve before this arrival time; calculating a time at which the gap between the exhaust valve and piston reaches a first predetermined value on the basis of the rotation speed and so on of the internal combustion engine, and stopping the exhaust valve closing operation temporarily when this time is reached; calculating a time at which the piston arrives at the stopping position of the exhaust valve on the basis of the rotation speed and so on of the internal combustion engine, and resuming the closing operation of the exhaust valve before this arrival time.

Stoppage and resumption of the exhaust valve closing operation may be repeated until the displacement of the exhaust valve is equal to or less than a predetermined valve displacement on overlap condition at the time when the gap between the exhaust valve and piston reaches the first predetermined value. When the displacement of the exhaust valve is equal to or less than the predetermined valve displacement on overlap condition at the time when the gap between the exhaust valve and piston reaches the first predetermined value, the exhaust valve closing operation may be stopped temporarily at the point where the displacement of the exhaust valve matches the valve displacement on overlap condition, and then, when the crank angle of the internal combustion engine reaches a predetermined angle, the exhaust valve may be closed to a fully closed position.

The average traveling speed of the exhaust valve when the exhaust valve is moved from its current position to the fully closed position, and the traveling speed of the piston when the piston arrives at the current position of the exhaust valve, may be calculated, and the control method may be executed only when the average traveling speed of the exhaust valve is higher than the traveling speed of the piston.

When the average traveling speed of the exhaust valve is equal to or lower than the traveling speed of the piston, a time at which the traveling speed of the piston matches the average traveling speed of the exhaust valve, and the position of the piston at this time, may be calculated on the basis of the rotation speed and so on of the internal combustion engine. An exhaust valve closing operation start time may then be determined on the basis of the calculation result, the average traveling speed of the exhaust valve, and so on, such that the gap between the exhaust valve and piston reaches a second predetermined value at the time when the traveling speed of the piston matches the average traveling speed of the exhaust valve. The exhaust valve closing operation may then be started at this exhaust valve closing operation start time.

When the current position of the exhaust valve is $X_0$, a connecting rod length is l, and a piston stroke is 2r, a crank angle $A_{c0}$ when the piston arrives at the current position $X_0$ of the exhaust valve may be calculated on the basis of the following equation 8,

[EQUATION 8]

$$A_{c0} = \cos^{-1}\left(\frac{-l^2 + \sqrt{l^2 + r^2 + 2lr - 2lX_0}}{r}\right) \quad (8)$$

and then, when the current crank angle is $A_{cc}$ and the rotation speed of the internal combustion engine is Ne, a time $T_0$ at which the piston arrives at the current position $X_0$ of the exhaust valve may be calculated on the basis of the following equation 10.

[EQUATION 10]

$$T_0 = \frac{60 \cdot (A_{c0} - A_{cc})}{360 \cdot N_e} \quad (10)$$

When the current position of the exhaust valve is $X_0$, an arbitrary position of the exhaust valve is Y, the energy released when the exhaust valve is closed from its current position $X_0$ to the arbitrary position Y is $E_{release}$, the mass of the movable portions of the exhaust valve is m, and predetermined correction coefficients are $C_{gain}$ and $C_{offset}$, a time period $T_{cy}$ required for the exhaust valve to close from its current position $X_0$ to the arbitrary position Y may be calculated on the basis of the following equation

[EQUATION 11]

$$T'_{cy} = \frac{X_0 - Y}{\sqrt{\frac{2 \cdot E_{release}}{m}}} \times C_{gain} + C_{offset} \quad (11)$$

and the position of the exhaust valve at an arbitrary time t may be determined on the basis of this time period $T_{cy}$ and the closing operation start time of the exhaust valve. Meanwhile, when the rotation speed of the internal combustion engine is Ne and the current crank angle is $A_{cc}$, a crank angle θt at the arbitrary time t may be determined on the basis of the following equation 12,

[EQUATION 12]

$$\theta_t = \frac{360 \cdot N_e \cdot t}{60} + A_{cc} \quad (12)$$

and when the connecting rod length is l and the piston stroke is 2r, a piston position $X_{pt}$ at the arbitrary time t may be determined on the basis of the following equation 13,

[EQUATION 13]

$$X_{pt} = r\left[(1 - \cos\theta_t) + \frac{r}{4l}(1 - \cos 2\theta_t)\right] \quad (13)$$

and the time at which the gap between the exhaust valve and piston reaches the first predetermined value may be determined on the basis of the exhaust valve position at the arbitrary time t and the piston position $X_{pt}$ at the arbitrary time t.

When the crank angle at which the piston arrives at the current position of the exhaust valve is θt, the rotation speed of the internal combustion engine is Ne, the connecting rod length is l, and the piston stroke is 2r, a piston traveling speed $V_{piston}$ when the piston arrives at the current position of the exhaust valve may be determined on the basis of the following equation 9.

[EQUATION 9]

$$V_{piston} = r \cdot \frac{2\pi N_e}{60}\left(\sin\theta_t + \frac{r}{2l}\sin 2\theta_t\right) \quad (9)$$

Another aspect of the present invention, conceived to achieve the object described above, is an exhaust valve drive control device comprising a pressure chamber supplied with a pressurized operating fluid for opening an exhaust valve of an internal combustion engine, high pressure operating fluid supply means for supplying high pressure operating fluid to the pressure chamber to operate the exhaust valve in an opening direction, operating fluid discharging means for discharging the operating fluid from the pressure chamber to operate the exhaust valve in a closing direction, and a control device for controlling the high pressure operating fluid supply means and operating fluid discharging means. When the exhaust valve is controlled to close, the control device functions to: first calculate a time at which a piston arrives at the current position of the exhaust valve on the basis of the current position of the exhaust valve and the rotation speed of the internal combustion engine; output a drive signal to the operating fluid discharging means to start a closing operation of the exhaust valve before this arrival time; calculate a time at which the gap between the exhaust valve and piston reaches a predetermined value on the basis of the rotation speed and so on of the internal combustion engine and temporarily halt output of the drive signal to the operating fluid discharging means in order to stop the exhaust valve closing operation temporarily when this time is reached; and calculate, on the basis of the rotation speed and so on of the internal combustion engine, a time at which the piston arrives at the stopping position of the exhaust valve and output the drive signal to the operating fluid discharging means in order to resume the exhaust valve closing operation before this arrival time.

The control device may repeat stoppage and resumption of the exhaust valve closing operation until the displacement of the exhaust valve is equal to or less than a predetermined valve displacement on overlap condition at the time when the gap between the exhaust valve and piston reaches the predetermined value. When the displacement of the exhaust valve is equal to or less than this valve displacement on overlap condition at the time when the gap between the exhaust valve and piston reaches the predetermined value, the control device may temporarily halt output of the drive signal to the operating fluid discharging means in order to stop the exhaust valve closing operation temporarily at the point where the displacement of the exhaust valve matches the valve displacement on overlap condition. Then, when the crank angle of the internal combustion engine reaches a predetermined angle, the control device may output the drive signal to the operating fluid discharging means in order to close the exhaust valve to the fully closed position.

The operating fluid discharging means may comprise an operating valve for switching between discharging and halting the discharge of the operating fluid from the pressure chamber. Thus, during the exhaust valve closing operation, the control device may output a drive signal to the operating valve to open the operating valve, and during the temporary stoppage of the exhaust valve closing operation, the control device may halt output of the drive signal to the operating valve to fully close the operating valve.

DESCRIPTION OF THE PREFERRED EMBODIMENTS

The "exhaust valve drive control method and device" described in the present specification, claims, and drawings are those described in Japanese Patent Application 2004-179699.

A preferred embodiment of the present invention will now be described on the basis of the attached drawings.

Figure 1:
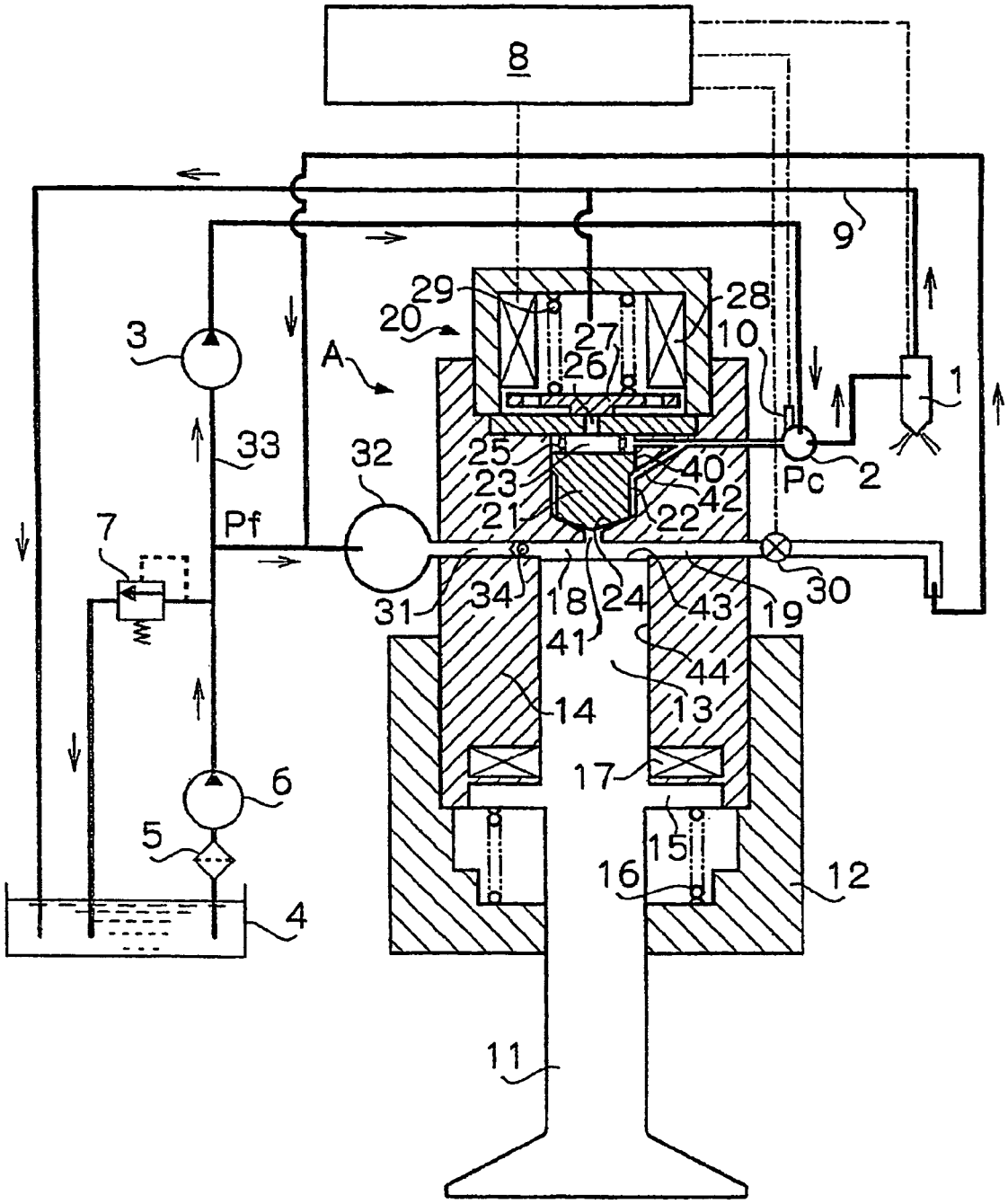
FIG. 1 is a sectional view of an exhaust valve drive control device according to an embodiment of the present invention.

FIG. 1 shows an exhaust valve drive control device according to this embodiment.

The exhaust valve drive control device of this embodiment is applied to a diesel engine comprising a common rail-type fuel injection device. First, to describe this common rail-type fuel injection device, an injector 1 is provided for executing fuel injection into each cylinder of the engine, and high pressure fuel stored within a common rail 2 at a common rail pressure Pc (between several tens and several hundreds of MPa, for example) is supplied to the injector 1 constantly. The fuel is pumped to the common rail 2 through a high pressure pump 3. Fuel in a fuel tank 4 is aspirated through a fuel filter 5 by a feed pump 6, and then conveyed to the high pressure pump 3. A feed pressure Pf of the feed pump 6 is regulated to a constant level by a pressure control valve 7 comprising a relief valve. Naturally, the feed pressure Pf is lower than the common rail pressure Pc, and set at approximately 0.5 MPa, for example.

An electronic control unit (ECU hereafter) 8 is provided as a control device for performing general control of the entire illustrated device, and sensors (not shown in the drawing, but including a crank angle sensor, an engine rotation sensor, an accelerator opening sensor, and so on) for detecting the engine operating conditions (the crank angle, rotation speed, load, and so on of the engine) are connected to the ECU 8. The ECU 8 learns the engine operating conditions on the basis of signals from these sensors, and transmits a drive signal based on the learned operating conditions to an electromagnetic solenoid of the injector 1 in order to control the opening and the closing of injector 1. Fuel injection is executed and halted in accordance with the ON/OFF state of the electromagnetic solenoid. When injection is halted, fuel at approximately normal pressure is returned to the fuel tank 4 from the injector 1 through a return circuit 9. The ECU 8 feedback-controls the actual common rail pressure toward a target pressure on the basis of the engine operating conditions. For this purpose, a common rail pressure sensor 10 is provided for detecting the actual common rail pressure.

Next, the exhaust valve drive control device of the present invention will be described. The reference numeral 11 denotes the engine exhaust valve. The exhaust valve 11 is supported elevatably in a cylinder head 12 such that the upper end portion of the exhaust valve 11 forms an integral valve piston 13. In other words, the valve piston 13 is joined integrally to the exhaust valve 11. An actuator A is provided above the exhaust valve 11. An actuator body 14 is fixed to the cylinder head 12 such that the valve piston 13 is capable of sliding vertically within the actuator body 14. Note that in this embodiment, the exhaust valve 11 and valve piston 13 are formed integrally, but may be constituted as separate bodies.

A flange portion 15 is provided on the exhaust valve 11, and a valve spring 16 for urging the exhaust valve 11 in a valve closing direction (upward in the drawing) is disposed between the flange portion 15 and cylinder head 12 in a compressed state. Here, the valve spring 16 comprises a coil spring. A magnet 17 for attracting the flange portion 15 is buried within the actuator body 14, and the exhaust valve 11 is also urged in the valve closing direction by this magnet 17. Here, the magnet 17 is an annular permanent magnet surrounding the exhaust valve 11. The valve piston 13 comprises at least the upper end part of the exhaust valve 11, and is inserted in the actuator body 14 so as to form a shaft seal.

A pressure chamber 18 facing the upper end surface (i.e. a pressure-receiving surface 43) of the valve piston 13 is defined within the actuator body 14. The pressure chamber 18 is supplied with pressurized operating fluid used to open the exhaust valve 11, and the bottom surface part of the pressure chamber 18 is defined by the pressure receiving surface 43. Here, the operating fluid comprises light oil that is also used as the fuel of the engine. When the high pressure fuel is introduced into the pressure chamber 18, the exhaust valve 11 is pushed in the opening direction (downward in the drawing). When this pushing pressure exceeds the urging force of the valve spring 16 and magnet 17, the exhaust valve 11 is opened (lifted) downward. Meanwhile, a discharge passage 19 is connected to the pressure chamber 18, and when the high pressure fuel in the pressure chamber 18 is discharged through the discharge passage 19, the exhaust valve 11 closes.

A first operating valve 20 for switching between supplying and halting the supply of high pressure fuel to the pressure chamber 18 is provided above the pressure chamber 18. Here, the first operating valve 20 employs a pressure balance control valve system.

More specifically, the first operating valve 20 comprises a needle-form balance valve 21 disposed coaxially with the exhaust valve 11. A shaft seal portion 40 is formed at the upper end portion of the balance valve 21. A supply passage 22 is formed below the shaft seal portion 40, and a valve control chamber 23 is formed above the shaft seal portion 40. The upper end surface of the balance valve 21 serves as a pressure receiving surface on which the fuel pressure inside the valve control chamber 23 acts. The supply passage 22 and valve control chamber 23 are connected to the common rail 2, which serves as a high pressure operating fluid supply source, via a bifurcation passage 42 formed in the actuator body 14 and an external pipe, and thus the supply passage 22 and valve control chamber 23 are supplied with high pressure fuel at the common rail pressure Pc at all times. The first operating valve 20, common rail 2, and so on comprise high pressure operating fluid supply means.

The supply passage 22 faces the lower portion side of the balance valve 21, thereby communicating with the pressure chamber 18, and comprises a valve seat 24 at a point thereon which is contacted in either linear contact or surface contact by a lower end conical surface of the balance valve 21. An outlet 41 of the supply passage 22 (in other words, a high pressure fuel inlet into the pressure chamber 18) is provided on the downstream side of the valve seat 24. The outlet 41 is positioned coaxially with the exhaust valve 11, and oriented toward the pressure receiving surface 43 of the valve piston 13 such that the high pressure fuel that is discharged or injected from the outlet 41 is led into the pressure chamber 18. Further, the outlet 41 is oriented in the same direction as the traveling direction or axial direction of the exhaust valve 11 or valve piston 13, and the pressure receiving surface 43 is a circular face perpendicular to this axial direction.

A spring 25 for urging the balance valve 21 in a closing direction (downward in the drawing) is provided in the valve control chamber 23. The spring 25 comprises a coil spring, and inserted into the valve control chamber 23 in a compressed state. Further, the valve control chamber 23 communicates with the return circuit 9 via an orifice 26 serving as a fuel outlet. An armature 27 serving as an open/close valve for opening and closing the orifice 26 is provided elevatably above the orifice 26, and an electromagnetic solenoid 28 serving as an electric actuator for driving the armature 27 to rise and fall (open and close), and an armature spring 29, are provided above the armature 27. The electromagnetic solenoid 28 is connected to the ECU 8, and is ON/OFF controlled by a signal, or in other words a command pulse, from the ECU 8.

Normally, when the electromagnetic solenoid 28 is OFF, the armature 27 is pushed downward by the armature spring 29 so that the orifice 26 is closed. When the electromagnetic solenoid 28 is switched ON, the armature 27 is raised against the urging force of the armature spring 29, thereby opening the orifice 26.

A low pressure chamber 32 serving as a low pressure operating fluid supply source having a predetermined capacity is connected directly to the pressure chamber 18 via a low pressure passage 31 formed inside the actuator body 14. The low pressure chamber 32 is connected to a feed circuit 33 on the downstream side of the pressure control valve 7 and the upstream side of the high pressure pump 3. Low pressure fuel at the feed pressure Pf is introduced into the low pressure chamber 32 from the feed circuit 33 at all times, and stored therein. A mechanical check valve 34, serving as a second operating valve which is opened only when the pressure in the pressure chamber 18 is equal to or lower than the pressure in the low pressure chamber 32, is provided in the low pressure passage 31. The low pressure chamber 32, second operating valve 34, and so on comprise low pressure operating fluid introducing means.

A third operating valve 30 for switching between discharging and halting the discharge of fuel from the pressure chamber 18 is provided in the discharge passage 19. The third operating valve 30 comprises an electromagnetic throttle valve having a variable opening. The third operating valve 30 is connected to the ECU 8 and controlled to open and close by a drive signal, or in other words a command pulse, from the ECU 8. Here, the outlet side of the discharge passage 19 is connected to the feed circuit 33 on the downstream side of the pressure control valve 7 and the upstream side of the high pressure pump 3, similarly to the low pressure chamber 32. The discharge passage 19, third operating valve 30, and so on comprise operating fluid discharging means.

The pressure chamber 18 comprises mainly a piston insertion hole 44 having a circular cross section and a fixed diameter, which is formed inside the actuator body 14. The valve piston 13 is inserted slidably into the piston insertion hole 44. Thus, as the exhaust valve 11 moves from a fully closed position to a fully open position, the valve piston 13 remains in contact with the inner surface of the piston insertion hole 44 at all times, without disengaging from (slipping out of) the piston insertion hole 44. In other words, as the exhaust valve 11 moves from the fully closed position to the fully open position, the ratio between the traveling distance of the valve piston 13 and the amount of increase in the capacity of the pressure chamber 18 remains constant.

When the exhaust valve 11 is to be opened by this exhaust valve drive control device, the electromagnetic solenoid 28 is switched ON for a predetermined time period by the ECU 8. Then, in the first operating valve 20, the armature 27 rises to open the orifice 26, whereupon the high pressure fuel in the valve control chamber 23 is discharged. As a result, the balance valve 21 rises away from the valve seat 24. This causes the supply passage 22 to open such that high pressure fuel is injected momentarily and rapidly from the outlet 41 of the supply passage 22 into the pressure chamber 18. This high pressure fuel pushes against the pressure receiving surface 43 of the valve piston 13 such that an initial energy is applied to the exhaust valve 11. The exhaust valve 11 then performs an inertial motion under the conditions of the force applied by the valve spring 16 and magnet 17, and is thereby moved downward.

During the inertial motion process of the exhaust valve 11, the capacity of the pressure chamber 18 increases steadily, but since the motion of the exhaust valve 11 is inertial motion generated by high pressure fuel of between several tens and several hundreds of MPa, the actual increase in the capacity of the pressure chamber 18 is greater than the logical increase in the capacity of the pressure chamber 18 corresponding to the high pressure fuel supply amount, and hence the pressure in the pressure chamber 18 decreases below the pressure in the low pressure chamber 32. As a result, the check valve 34 opens automatically such that the low pressure fuel in the low pressure chamber 32 is introduced directly into the pressure chamber 18 through the low pressure passage 31. In other words, the low pressure chamber 32 is replenished with fuel to compensate for the excessive increase in the capacity of the pressure chamber 18. In so doing, a greater amount of fuel than the actual high pressure fuel supply amount is supplied into the pressure chamber 18, and therefore negative pressure in the pressure chamber 18 can be avoided, the valve lifting operation can be stabilized, and the valve displacement can be held at a displacement which corresponds to the initial energy applied through the high pressure fuel supply.

When the exhaust valve 11 is to be closed, the first operating valve 20 is held in a closed position (the electromagnetic solenoid 28 is switched OFF), and the third operating valve 30 is switched ON (opened). As a result, the high pressure fuel in the pressure chamber 18 is discharged to the feed circuit 33 through the discharge passage 19. Thus the pressure in the pressure chamber 18 falls, and the exhaust valve 11 is raised, i.e. closed, by the urging force of the valve spring 16 and magnet 17.

If the third operating valve 30 is switched OFF (fully closed) during the closing operation of the exhaust valve 11, discharge of the high pressure fuel from the pressure chamber 18 is halted, and hence the exhaust valve 11 is held at its current displacement (position). In other words, by fully closing the third operating valve 30 during the closing operation of the exhaust valve 11, the closing operation of the exhaust valve 11 can be halted temporarily.

A feature of the exhaust valve drive control device of this embodiment is simple modeling of the closing operation of the exhaust valve 11 and control of the closing operation of the exhaust valve 11 based on this simple model. These points will now be described.

First, in the exhaust valve drive control device shown in FIG. 1, a force F in the valve closing direction (upward) which acts on the exhaust valve 11 at an arbitrary displacement x of the exhaust valve 11 is determined according to the following equation 1.

[EQUATION 1]

$$F=F_{other}+K\cdot x+F_{set} \quad (1)$$

Here, K is a spring constant of the spring 16, Fset is a set force of the spring 16, and Fother is an external force (in this embodiment, the attraction of the permanent magnet 17) other than the force of the spring 16. The relationship between the force F and the displacement x is shown by a line a in FIG. 2.

Next, an impulse E at an arbitrary displacement A of the exhaust valve 11 is determined according to the following equation 2 as a function f (x) of the displacement.

[EQUATION 2]

$$E = f(x) = \int_0^A F \cdot dx \quad (2)$$

Figure 2:
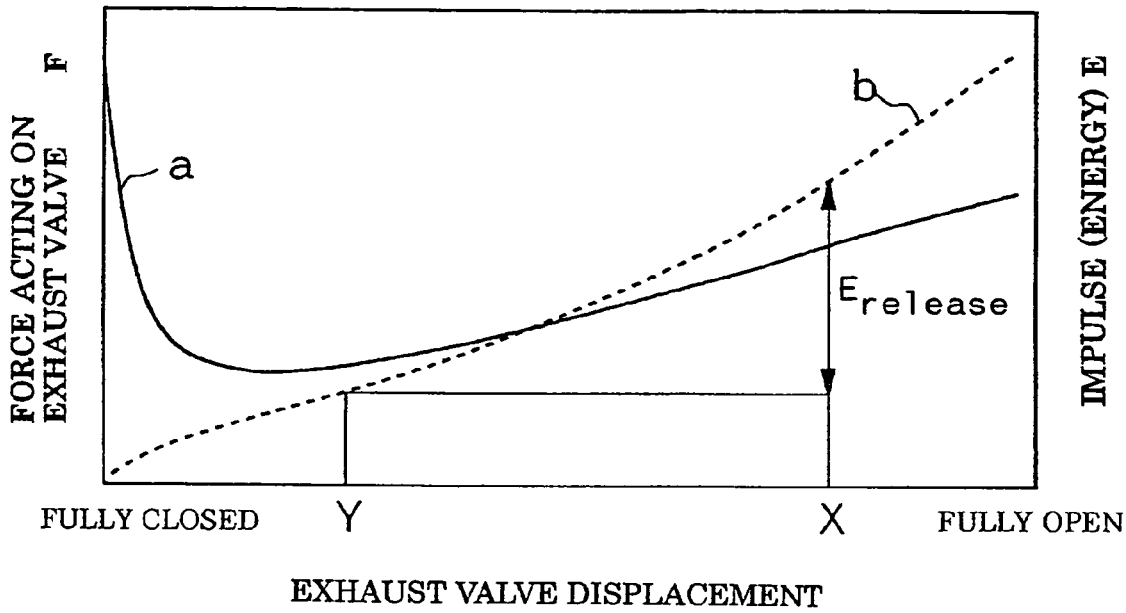
FIG. 2 is a graph showing a relationship between a displacement of the exhaust valve, and a force and impulse acting on the exhaust valve.

The relationship between the impulse E and the displacement x is shown by a line b in FIG. 2.

Here, the impulse E is an integrated value of force (N)×length (m), and therefore has an energy (J) dimension. Accordingly, an energy $E_{release}$ (see FIG. 2) released when the exhaust valve 11 is closed from a current displacement X to an arbitrary target displacement Y is determined from the following equation 3.

[EQUATION 3]

$$E_{release}=f(X)-f(Y) \quad (3)$$

This released energy $E_{release}$ is all converted into the closing speed (traveling speed) of the exhaust valve 11, and when considered as the average traveling speed of the exhaust valve 11, an average traveling speed $V_{ave}$ of the exhaust valve 11 and a time (return time) $T_{cY}$ required for the exhaust valve 11 to travel from the displacement X to the displacement Y are determined by the following equations 4, 5, respectively.

[EQUATION 4]

$$V_{ave} = \sqrt{\frac{2 \cdot E_{release}}{m}} \quad (4)$$

[EQUATION 5]

$$T_{cY}=(X-Y)/V_{ave} \quad (5)$$

Here, m is the mass of the movable portions.

Figure 3:
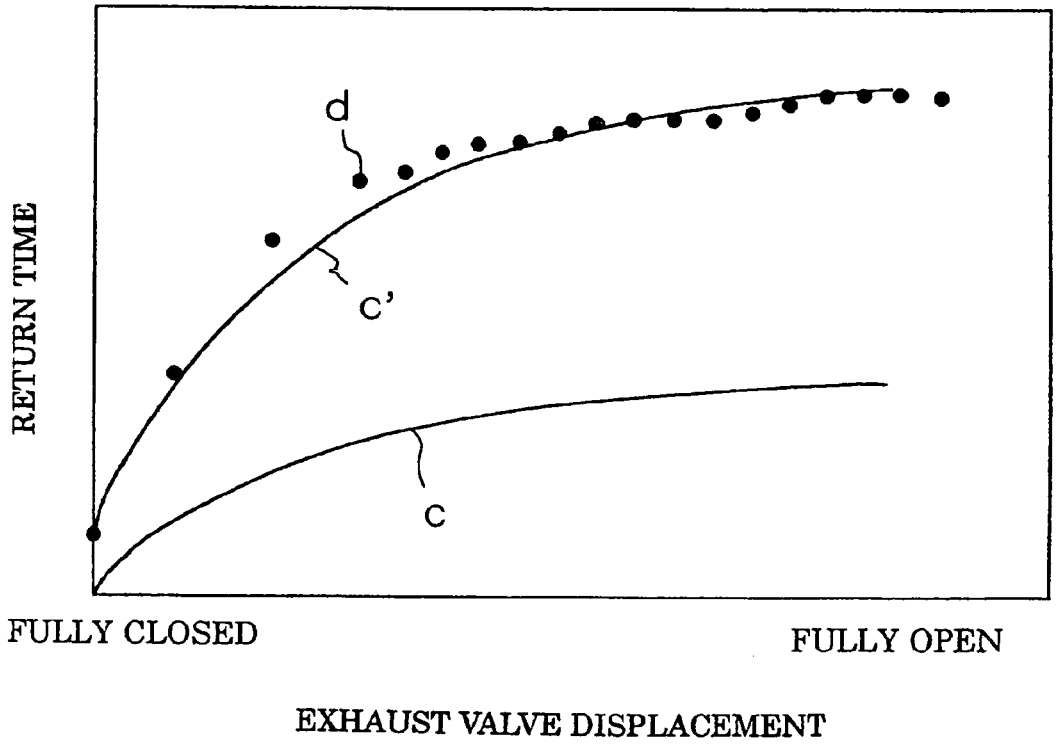
FIG. 3 is a graph showing a relationship between the exhaust valve displacement and a return time required for the exhaust valve to return to a fully closed position.

On the basis of the equation 5, the present applicant calculated an estimated return time for the exhaust valve 11 to travel from an arbitrary displacement (position) to the fully closed position (displacement zero), and compared the calculation result with a return time obtained in a detailed hydraulic simulation. The result is shown in FIG. 3. A line c in the drawing denotes the estimated return time calculated on the basis of the equation 5, and circles d denote the return time obtained in the simulation.

As can be seen from the drawing, there is a difference between the result c calculated on the basis of the equation 5 and the simulation result d. To eliminate this difference, correction such as that shown in the following equation 6 is required.

[EQUATION 6]

$$T'_{cY}=T_{cY}\times C_{gain}+C_{offset} \quad (6)$$

Here, $C_{gain}$ and $C_{offset}$ are both correction coefficients.

During an actual valve closing operation, friction is produced by the various sliding portions, and hence not all of the aforementioned released energy $E_{release}$ is converted into traveling speed. This frictional damping portion is corrected by the correction coefficient $C_{gain}$. Further, a time lag (operating delay) exists between the output of a drive signal (command pulse) from the ECU 8 to open the third operating valve 30 and the start of the actual closing operation (raising) of the exhaust valve 11 following a reduction in the pressure of the pressure chamber 18. This operating delay is corrected by the correction coefficient $C_{offset}$.

The corrected return time of the exhaust valve 11, calculated on the basis of the equation 6, is shown by a line c' in FIG. 3. Note that in this example, the correction coefficients $C_{gain}$ and $C_{offset}$ are set at 2.15 and 0.5, respectively. As can be seen from the drawing, the corrected calculation result based on the equation 6 takes a substantially identical value to the detailed simulation result d. Hence the return time of the exhaust valve 11 from an arbitrary position to an arbitrary position can be determined using the equation 6.

Further, the average traveling speed of the exhaust valve 11 can be determined on the basis of the following equation 7.

[EQUATION 7]

$$V'_{ave}=\frac{X-Y}{T'_{cY}} \quad (7)$$

By using the equations 6 and 7 in this manner, a time $T'_{cY}$ required for the exhaust valve 11 to travel (close) from the arbitrary displacement (position) X to the arbitrary displacement Y and an average traveling speed $V'_{ave}$ during this time can be determined.

Figure 5:
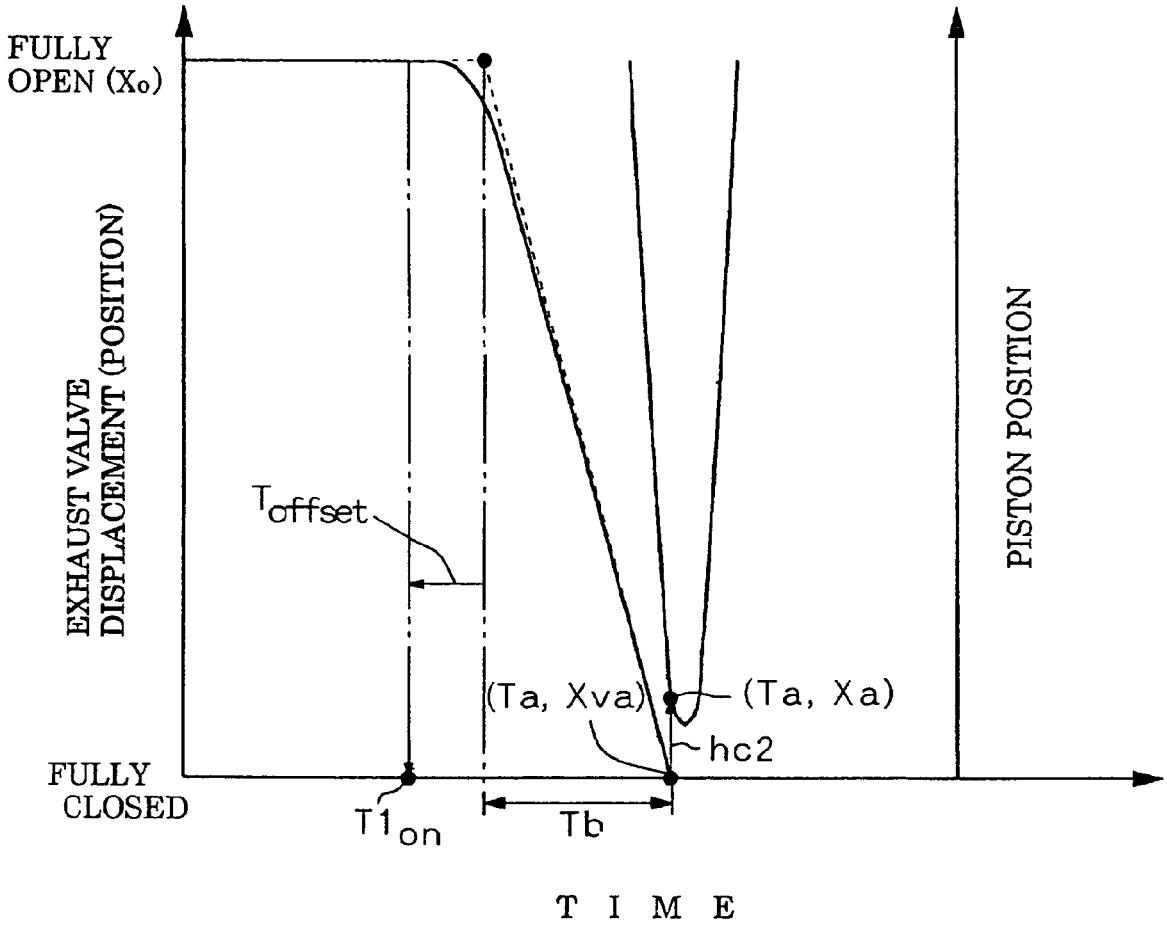
FIG. 5 is a view illustrating the content of valve closing control when the average traveling speed of the exhaust valve is equal to or lower than the traveling speed of the piston.
Figure 6:
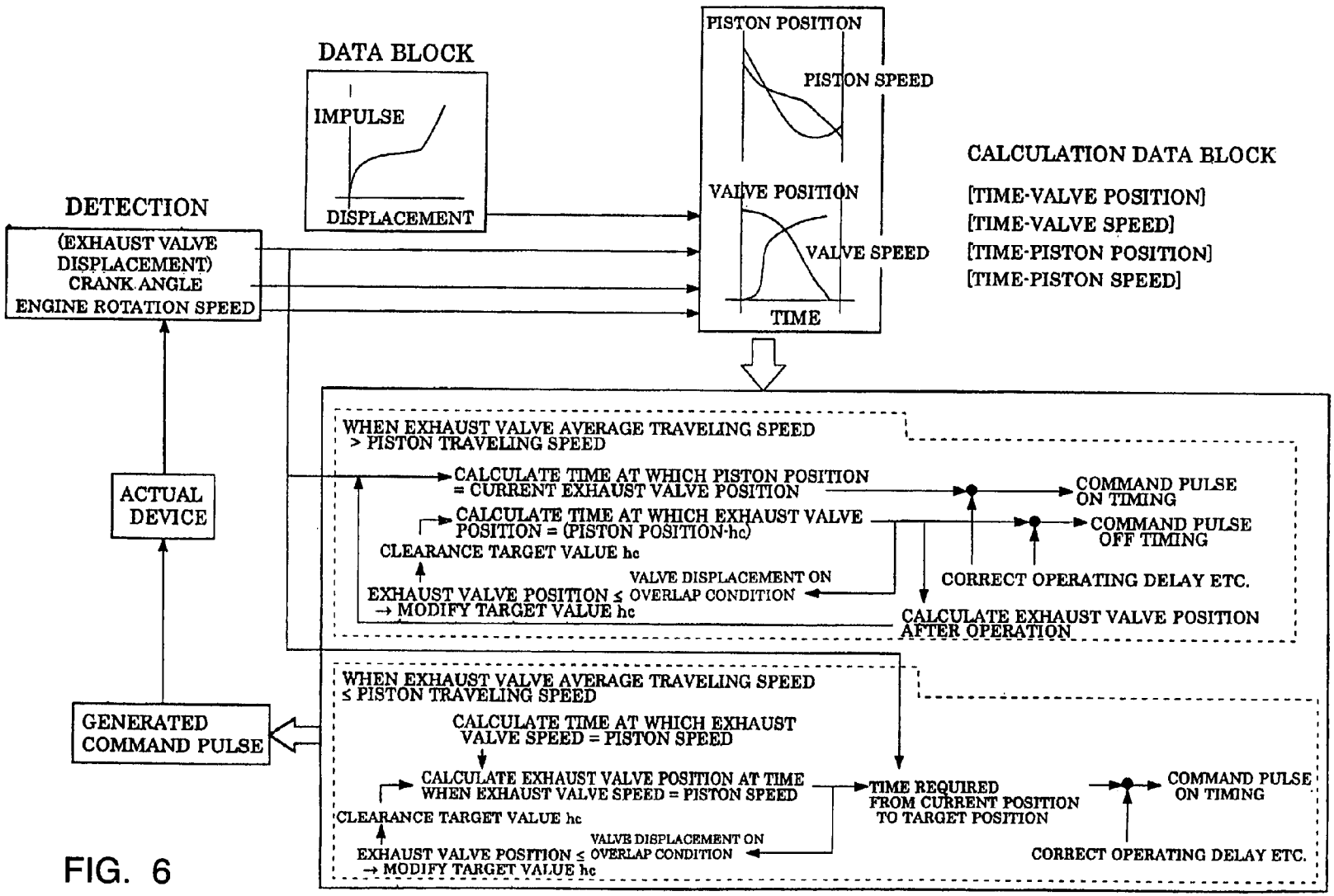
FIG. 6 is a control flowchart illustrating the content of valve closing control performed by the exhaust valve drive control device according to this embodiment of the present invention.
Figure 7A:
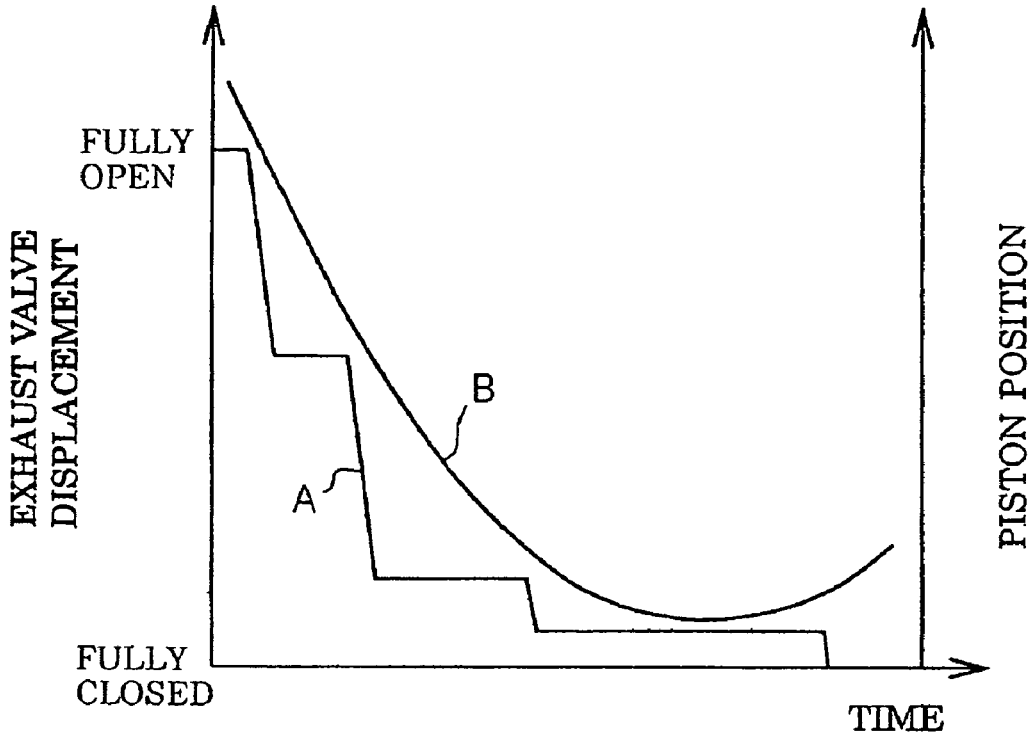
FIG. 7 is a view showing exhaust valve closing control proposed by the present applicant, A illustrating a case in which the piston traveling speed is lower than the exhaust valve traveling speed, and B illustrating a case in which the piston traveling speed is higher than the exhaust valve traveling speed.
Figure 7B:
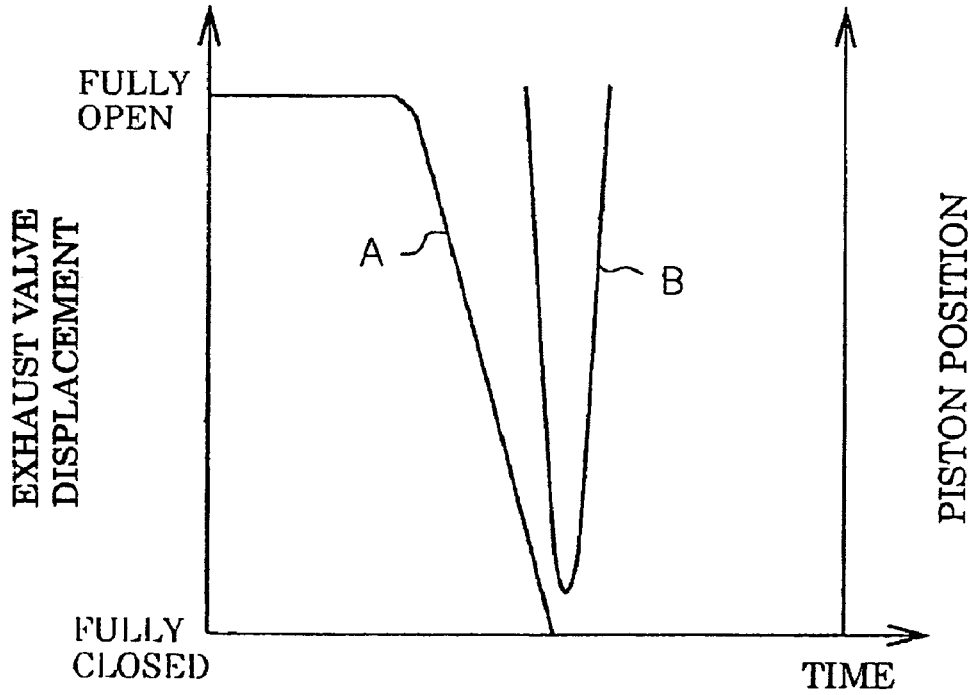

In consideration of the above points, a control method for closing the exhaust valve 11 using the exhaust valve drive control device of this embodiment will now be described using FIGS. 4 to 6. Note that in FIGS. 4 and 5, the lower end of the ordinate denotes the exhaust valve position when fully closed (zero displacement). Moving upward steadily along the ordinate, the displacement (opening) of the exhaust valve increases and the position of a piston (a piston of the engine, not shown in FIG. 1) falls. In other words, in these drawings the positional relationship and traveling directions of the exhaust valve and the piston are illustrated upside-down from the actual positional relationship and traveling directions.

When controlling the exhaust valve 11 to close, first the ECU 8 determines an average traveling speed assuming that the exhaust valve 11 is closed to the fully closed position, and a piston traveling speed when the piston reaches the current position (fully open position) of the exhaust valve 11, and compares the two. The reason for doing so is that the content of the valve closing control differs greatly when the average traveling speed of the exhaust valve 11 is faster than the piston traveling speed, and when the average traveling speed of the exhaust valve 11 is equal to or lower than the piston traveling speed.

When control to close the exhaust valve 11 is begun, the displacement of the exhaust valve 11 is a maximum displacement $X_0$, and this value $X_0$ is inputted into the ECU 8 in advance. The ECU 8 uses this maximum displacement $X_0$ and the aforementioned equation 7 to determine the average traveling speed $V'_{ave}$ of the exhaust valve 11 when the exhaust valve 11 is closed from its current displacement $X_0$ to a fully closed position Y (displacement zero).

Meanwhile, on the basis of a connecting rod length l and a piston stroke 2*r*, which are input into the ECU 8 in advance, the ECU 8 determines a crank angle $A_{c0}$ when the top end portion (top land) of the piston reaches the current position $X_0$ of the exhaust valve 11 from the following equation 8.

[EQUATION 8]

$$A_{c0}=\cos^{-1}\left(\frac{-l^2+\sqrt{l^2+r^2+2lr-2lX_0}}{r}\right) \quad (8)$$

Here, assuming that the engine rotation speed detected by the engine rotation sensor is Ne, a piston traveling speed $V_{piston}$ (rising speed) at an arbitrary crank angle θt is determined according to the following equation 9.

[EQUATION 9]

$$V_{piston}=r\cdot\frac{2\pi N_e}{60}\left(\sin\theta_t+\frac{r}{2l}\sin 2\theta_t\right) \quad (9)$$

Hence, by assigning the crank angle $A_{c0}$, determined in the aforementioned equation 8, to the crank angle θt in the equation 9, the piston traveling speed $V_{piston}$ when the piston reaches the current position $X_0$ of the exhaust valve 11 is determined.

The ECU 8 compares the average traveling speed $V'_{ave}$ of the exhaust valve 11 and the piston traveling speed $V_{piston}$ determined in this manner, and switches between two types of valve closing control in accordance with the comparison result.

First, the content of control when the average traveling speed $V'_{ave}$ of the exhaust valve 11 is faster than the piston traveling speed $V_{piston}$ will be described using FIGS. 4 and 6.

First, on the basis of the crank angle $A_{c0}$ when the upper end portion of the piston reaches the current position $X_0$ of the exhaust valve 11, a current crank angle $A_{cc}$ detected by the crank angle sensor, and the current engine rotation speed Ne detected by the engine rotation sensor, the ECU 8 determines a time $T_0$ at which the upper end portion of the piston reaches the current position $X_0$ of the exhaust valve 11 from the following equation 10.

[EQUATION 10]

$$T_0=\frac{60\cdot(A_{c0}-A_{cc})}{360\cdot N_e} \quad (10)$$

Then, in order to start the closing operation of the exhaust valve 11 before this arrival time $T_0$, the ECU 8 sets a time $T1_{on}$, which is moved back from the time $T_0$ by an offset period $T_{offset}$ that takes into account a safety factor for preventing contact between the piston and exhaust valve 11 and the operating delay of the exhaust valve 11, as the timing for outputting a closing signal to close the exhaust valve 11. In other words, at this time $T1_{on}$, the third operating valve 30 is switched ON (opened). As a result, the closing (upward travel) operation of the exhaust valve 11 begins following the elapse of the operation delay from the time $T1_{on}$ (before the time $T_0$).

Meanwhile, on the basis of the closing operation start time of the exhaust valve 11 and the aforementioned equation 6, the ECU 8 determines the position of the exhaust valve 11 at an arbitrary time. In other words, by substituting the equations 4 and 5 into the equation 6 and setting the current position X as the maximum displacement $X_0$, the following equation 11 is obtained.

[EQUATION 11]

$$T'_{cy} = \frac{X_0 - Y}{\sqrt{\frac{2 \cdot E_{release}}{m}}} \times C_{gain} + C_{offset} \quad (11)$$

The equation 11 is a function of the position Y of the exhaust valve 11 and the time period $T'_{cy}$ required to reach this position, and hence the position of the exhaust valve 11 at the arbitrary time t can be determined on the basis of the equation 11 and the closing operation start time (a time removed from the time $T1_{on}$ by the period of the operation delay) of the exhaust valve 11. The position of the exhaust valve 11 at the arbitrary time t is shown by a line e in FIG. 4. Note that the impulse (energy) $E_{release}$ acting on the displacement of the exhaust valve 11 and the mass m of the movable portions are inputted into the ECU 8 in advance.

Further, on the basis of the current engine rotation speed Ne detected by the engine rotation sensor and the current crank angle $A_{cc}$ detected by the crank angle sensor, the ECU 8 determines the crank angle θt at the arbitrary time t from the following equation 12,

[EQUATION 12]

$$\theta_t = \frac{360 \cdot N_e \cdot t}{60} + A_{cc} \quad (12)$$

and on the basis of θt, the connecting rod length l, and the piston stroke 2r, determines a piston position $X_{pt}$ at the arbitrary time t from the following equation 13. The piston position at the arbitrary time t is shown by a line f in FIG. 4.

[EQUATION 13]

$$X_{pt} = r\left[(1 - \cos\theta_t) + \frac{r}{4l}(1 - \cos 2\theta_t)\right] \quad (13)$$

On the basis of the exhaust valve position e and piston position f at the arbitrary time t determined in this manner, the ECU 8 determines a time $T_1$ at which the gap between the exhaust valve 11 and piston reaches a first predetermined value hc1 (a clearance target value), and a position $X_1$ of the exhaust valve 11 at this time $T_1$. The first predetermined value hc1 is set in advance, taking into account the exhaust gas scavenging ability, safety, and so on, and inputted into the ECU 8.

Then, to stop the closing operation of the exhaust valve 11 temporarily at the time $T_1$, the ECU 8 sets a time $T1_{off}$, which is moved back from the time $T_1$ by an offset period $T'_{offset}$ that takes into account the operating delay of the exhaust valve 11, as the timing for halting output of the closing signal for closing the exhaust valve 11. In other words, at this time $T1_{off}$, the third operating valve 30 is switched OFF (fully closed) temporarily. As a result, the closing operation of the exhaust valve 11 is halted temporarily at the time $T_1$, and the exhaust valve is maintained in its position at that time $X_1$.

Further, on the basis of the aforementioned equation 13 (the line f in FIG. 4), the ECU 8 determines a time $T_2$ at which the upper end portion of the piston reaches the stopping position (current position) $X_1$ of the exhaust valve 11, and sets a time $T2_{on}$, which is moved back from the time $T_2$ by the aforementioned offset period $T_{offset}$, as the timing for resuming output of the closing signal for closing the exhaust valve 11. In other words, at this time $T2_{on}$, the third operating valve 30 is switched ON (fully opened) again. Thus the closing operation of the exhaust valve 11 is resumed before the time $T_2$ at which the upper end portion of the piston reaches the stopping position $X_1$ of the exhaust valve 11.

A time $T_3$ at which the gap between the exhaust valve 11 and piston reaches the first predetermined value hc1, and a position $X_2$ of the exhaust valve 11 at this time $T_3$, are then determined again using a similar method to that described above, and the closing operation of the exhaust valve 11 is halted temporarily at the time $T_3$. The closing operation of the exhaust valve 11 is then resumed before the piston reaches the stopping position $X_2$ of the exhaust valve 11.

Thus the ECU 8 closes the exhaust valve 11 in stages in accordance with the traveling speed of the piston.

If the displacement of the exhaust valve 11 at the time when the gap between the exhaust valve 11 and piston reaches the first predetermined value hc1 is equal to or less than a predetermined valve displacement on overlap condition $X_{overlap}$, a time $T_4$ at which the displacement of the exhaust valve 11 matches the valve displacement on overlap condition $X_{overlap}$ is determined, and a time $T3_{off}$, which is moved back from the time $T_4$ by the aforementioned offset period $T'_{offset}$, is set as the timing for halting output of the closing signal for closing the exhaust valve 11. In other words, the first predetermined value hc1 is modified to a gap hc1' between the exhaust valve 11 and piston at the time $T_4$ when the displacement of the exhaust valve 11 matches the valve displacement on overlap condition $X_{overlap}$.

Thus the closing operation of the exhaust valve 11 is halted at the point in time when the displacement of the exhaust valve 11 matches the valve displacement on overlap condition $X_{overlap}$. Then, when an intake valve not shown in the drawing is opened and the crank angle reaches a predetermined angle, the ECU 8 switches ON (opens) the third operating valve 30, and closes the exhaust valve 11 to the fully closed position.

Thus the valve closing control of the exhaust valve 11 ends. By closing the exhaust valve 11 in stages in accordance with the traveling speed of the piston in this manner, a sufficient opening area can be secured for the exhaust outlet while avoiding contact between the piston and exhaust valve 11, and hence the scavenging efficiency can be improved.

Figure 4:
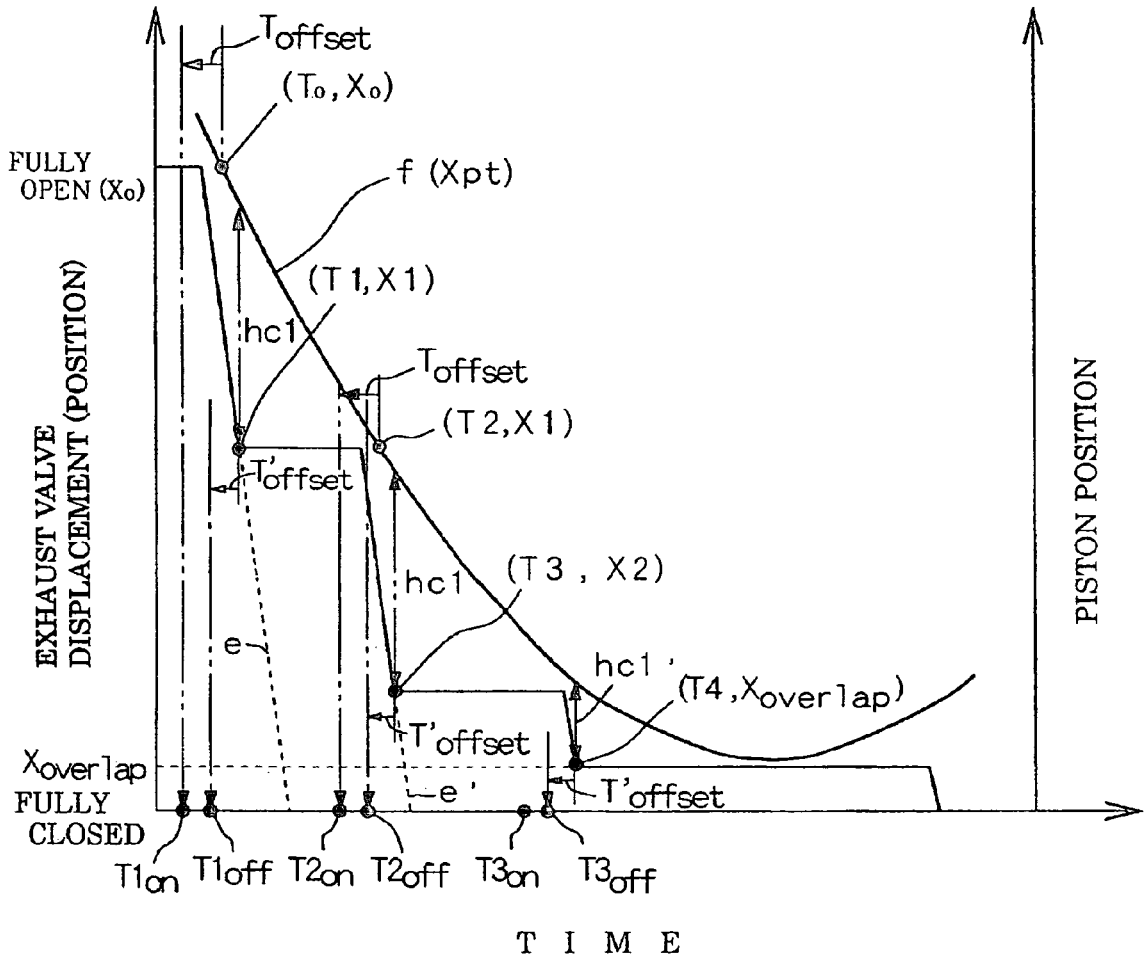
FIG. 4 is a view illustrating the content of valve closing control when an average traveling speed of the exhaust valve is higher than the traveling speed of a piston.

Note that FIG. 4 illustrates an example in which the exhaust valve 11 is closed in four stages, but the number of repeated closing operations varies according to the piston traveling speed (in other words, the engine rotation speed), the value of the first predetermined value hc1, and so on.

Next, the content of control when the average traveling speed $V'_{ave}$ of the exhaust valve 11 is equal to or less than the traveling speed $V_{piston}$ of the piston will be described using FIGS. 5 and 6.

First, on the basis of the aforementioned equation 9 and so on, the ECU 8 determines a time Ta at which the traveling speed $V_{piston}$ of the piston becomes equal to the average traveling speed $V'_{ave}$ of the exhaust valve 11.

Next, on the basis of the aforementioned Equation 13, a piston position Xa at the time Ta is determined, and a position Xva (displacement zero in FIG. 5), which is obtained by subtracting a second predetermined value hc2 (a clearance target value) from this piston position Xa, is set as a target displacement value of the exhaust valve 11 at the time Ta.

Next, the ECU 8 determines the exhaust valve closing operation start timing required to make the displacement of the exhaust valve 11 equal to Xva at the time Ta, or in other words to make the gap between the exhaust valve 11 and piston equal to the second predetermined value hc2 at the time Ta. More specifically, a period Tb required to close the exhaust valve 11 from its current displacement $X_0$ (the fully open position) to the target displacement Xva is determined according to the aforementioned equation 11, whereupon a time $T1_{on}$, which is moved back from the time Ta by the offset period $T_{offset}$ that takes into account the return period Tb, the operating delay, and so on, as the timing for outputting a closing signal for closing the exhaust valve 11. In other words, at this time $T1_{on}$, the third operating valve 30 is switched ON (opened). As a result, the closing operation of the exhaust valve 11 begins following the elapse of the operation delay from the time $T1_{on}$. In this case, the ECU 8 keeps the third operating valve 30 open until the exhaust valve 11 reaches a fully closed state. In other words, the exhaust valve 11 is closed from the fully open position to the fully closed position continuously (in a single operation).

According to the exhaust valve drive control device and method of this embodiment, as described above, the closing operation of the exhaust valve 11 is modeled easily, and the exhaust valve 11 is controlled to close in accordance with this model. Hence control maps are unnecessary, and the labor involved in creating such maps can be eliminated.

The present invention is not limited to the embodiment described above.

For example, in the embodiment described above, the position (displacement) of the exhaust valve 11 is determined through calculation, but means for detecting the position of the exhaust valve 11 may be provided so that the position of the exhaust valve 11 is detected directly.

Further, the exhaust valve drive control device of FIG. 1 is merely an example thereof, and the present invention may be applied to an exhaust valve drive control device of any structure, providing the device is capable of starting the closing operation of the exhaust valve 11 at an arbitrary timing and maintaining the exhaust valve 11 at an arbitrary displacement.

For example, in the embodiment described above, engine fuel (light oil) is used as the operating fluid, fuel at the common rail pressure is used as the high pressure operating fluid, and fuel at the feed pressure is used as the low pressure operating fluid, but the operating fluid may be normal oil or the like, and may be increased and decreased in pressure in a separate hydraulic device.

Further, in the embodiment described above, a valve spring and a magnet are used in conjunction to urge the valve in the closing operation direction, but either the valve spring or the magnet may be used individually. Moreover, in the embodiment described above, the flange portion is attracted by the magnet, but a different constitution may be employed.

Also in the embodiment described above, an example was described in which the present invention is applied to a diesel engine comprising a common rail-type fuel injection device. However, the present invention may be applied to a typical injection pump-type diesel engine, a gasoline engine, or another type of engine.

The first operating valve is not limited to a pressure balance control valve as described above, and may be a typical spool valve or the like. Furthermore, the third operating valve is not limited to a throttle valve as described above, and may also be a typical spool valve or the like. Further, in the pressure balance first operating valve of the embodiment described above, a piezoelectric element, giant-magnetostrictive element, or the like may be used instead of the electromagnetic solenoid as an electric actuator.

What is claimed is:

1. An exhaust valve drive control method for controlling a closing operation of an exhaust valve in an internal combustion engine, comprising the steps of:

first determining a current position of the exhaust valve and a rotation speed of the internal combustion engine, and then calculating a time at which a piston arrives at the current position of the exhaust valve on the basis of the current position and the rotation speed;

starting the closing operation of the exhaust valve before the arrival time;

calculating a time at which a gap between the exhaust valve and the piston reaches a first predetermined value on the basis of the rotation speed of the internal combustion engine, and stopping the exhaust valve closing operation temporarily when the time is reached; and calculating a time at which the piston arrives at the stopping position of the exhaust valve on the basis of the rotation speed of the internal combustion engine, and resuming the exhaust valve closing operation before the arrival time.

2. The exhaust valve drive control method according to claim 1, wherein stoppage and resumption of the exhaust valve closing operation are repeated until a displacement of the exhaust valve is equal to or less than a predetermined valve displacement on overlap condition at the time when the gap between the exhaust valve and the piston reaches the first predetermined value, and when the displacement of the exhaust valve is equal to or less than the valve displacement on overlap condition at the time when the gap between the exhaust valve and the piston reaches the first predetermined value, the exhaust valve closing operation is stopped temporarily at the point where the displacement of the exhaust valve matches the valve displacement on overlap condition, and then, when a crank angle of the internal combustion engine reaches a predetermined angle, the exhaust valve is closed to a fully closed position.

3. The exhaust valve drive control method, wherein an average traveling speed of the exhaust valve when the exhaust valve is moved from a current position to a fully closed position, and a traveling speed of a piston when the piston arrives at the current position of the exhaust valve, are calculated, and the control method according to claim 1 is executed only when the average traveling speed of the exhaust valve is higher than the traveling speed of the piston.

4. The exhaust valve drive control method, wherein an average traveling speed of the exhaust valve when the exhaust valve is moved from a current position to a fully closed position, and a traveling speed of a piston when the piston arrives at the current position of the exhaust valve, are calculated, and the control method according to claim 2 is executed only when the average traveling speed of the exhaust valve is higher than the traveling speed of the piston.

5. The exhaust valve drive control method according to claim 3, wherein, when the average traveling speed of the exhaust valve is equal to or lower than the traveling speed of the piston when the piston arrives at the current position of the exhaust valve, a time at which the traveling speed of the piston matches the average traveling speed of the exhaust valve, and a position of the piston at the time, are calculated on the basis of a rotation speed of an internal combustion engine, and on the basis of the calculation result, the average traveling speed of the exhaust valve, an exhaust valve closing operation start time is determined such that a gap between the exhaust valve and the piston reaches a second predetermined value at the time when the traveling speed of the piston matches the average traveling speed of the exhaust valve, the exhaust valve closing operation being started at the exhaust valve closing operation start time.

6. The exhaust valve drive control method according to claim 4, wherein, when the average traveling speed of the exhaust valve is equal to or lower than the traveling speed of the piston when the piston arrives at the current position of the exhaust valve, a time at which the traveling speed of the piston matches the average traveling speed of the exhaust valve, and a position of the piston at the time, are calculated on the basis of a rotation speed of an internal combustion engine, and on the basis of the calculation result, the average traveling speed of the exhaust valve, an exhaust valve closing operation start time is determined such that a gap between the exhaust valve and the piston reaches a second predetermined value at the time when the traveling speed of the piston matches the average traveling speed of the exhaust valve, the exhaust valve closing operation being started at the exhaust valve closing operation start time.

7. The exhaust valve drive control method according to claim 1, wherein, when the current position of the exhaust valve is $X_0$, a connecting rod length is l, and a piston stroke is 2*r*, a crank angle $A_{c0}$ when the piston arrives at the current position $X_0$ of the exhaust valve is calculated on the basis of a following equation 8,

[EQUATION 8]

$$A_{c0} = \cos^{-1}\left(\frac{-l^2 + \sqrt{l^2 + r^2 + 2lr - 2lX_0}}{r}\right) \quad (8)$$

and when the current crank angle is $A_{cc}$ and the rotation speed of the internal combustion engine is Ne, a time $T_0$ at which the piston arrives at the current position $X_0$ of the exhaust valve is then calculated on the basis of a following equation 10

[EQUATION 10]

$$T_0 = \frac{60 \cdot (A_{c0} - A_{cc})}{360 \cdot N_e}.$$

8. The exhaust valve drive control method according to claim 1, wherein, when the current position of the exhaust valve is $X_0$, an arbitrary position of the exhaust valve is Y, an energy released when the exhaust valve is closed from the current position $X_0$ to the arbitrary position Y is $E_{release}$, a mass of the movable portions of the exhaust valve is m, and predetermined correction coefficients are $C_{gain}$ and $C_{offset}$, a time period $T'_{cy}$ required for the exhaust valve to close from the current position $X_0$ to the arbitrary position Y is calculated on the basis of a following equation 11,

[EQUATION 11]

$$T'_{cy} = \frac{X_0 - Y}{\sqrt{\frac{2 \cdot E_{release}}{m}}} \times C_{gain} + C_{offset} \quad (11)$$

and the position of the exhaust valve at an arbitrary time t is determined on the basis of the time period $T'_{cy}$ and an exhaust valve closing operation start time, whereas, when the rotation speed of the internal combustion engine is Ne and a current crank angle is $A_{cc}$, a crank angle θt at the arbitrary time t is determined on the basis of a following equation 12,

[EQUATION 12]

$$\theta_t = \frac{360 \cdot N_e \cdot t}{60} + A_{cc} \quad (12)$$

and when a connecting rod length is l and a piston stroke is 2*r*, a piston position $X_{pt}$ at the arbitrary time t is determined on the basis of a following equation 13,

[EQUATION 13]

$$X_{pt} = r\left[(1 - \cos\theta_t) + \frac{r}{4l}(1 - \cos 2\theta_t)\right] \quad (13)$$

and a time at which the gap between the exhaust valve and the piston reaches the first predetermined value is determined on the basis of the exhaust valve position at the arbitrary time t and the piston position $X_{pt}$ at the arbitrary time t.

9. The exhaust valve drive control method according to claim 3, wherein, when a crank angle at which the piston arrives at the current position of the exhaust valve is θt, the rotation speed of the internal combustion engine is Ne, a connecting rod length is l, and a piston stroke is 2*r*, a piston traveling speed $V_{pistol}$ when the piston arrives at the current position of the exhaust valve is determined on the basis of a following equation 9

[EQUATION 9] ⑨

$$V_{piston} = r \cdot \frac{2\Pi N_e}{60}\left(\sin\theta_t + \frac{r}{2l}\sin 2\theta_t\right).$$

10. The exhaust valve drive control method according to claim 4, wherein, when a crank angle at which the piston arrives at the current position of the exhaust valve is θt, the rotation speed of the internal combustion engine is Ne, a connecting rod length is l, and a piston stroke is 2*r*, a piston traveling speed $V_{piston}$ when the piston arrives at the current position of the exhaust valve is determined on the basis of a following equation 9

[EQUATION 9] ⑨

$$V_{piston} = r \cdot \frac{2\Pi N_e}{60}\left(\sin\theta_t + \frac{r}{2l}\sin 2\theta_t\right).$$

11. An exhaust valve drive control device comprising a pressure chamber supplied with a pressurized operating fluid for opening an exhaust valve of an internal combustion engine, high pressure operating fluid supply means for supplying high pressure operating fluid to the pressure chamber in order to operate the exhaust valve in an opening direction, operating fluid discharging means for discharging the operating fluid from the pressure chamber in order to operate the exhaust valve in a closing direction, and a control device for controlling the high pressure operating fluid supply means and the operating fluid discharging means, wherein, when the exhaust valve is controlled to close, the control device functions to:

first calculate a time at which a piston arrives at a current position of the exhaust valve on the basis of the current position of the exhaust valve and a rotation speed of the internal combustion engine;

output a drive signal to the operating fluid discharging means to start a closing operation of the exhaust valve before the arrival time;

calculate a time at which a gap between the exhaust valve and the piston reaches a predetermined value on the basis of the rotation speed of the internal combustion engine, and temporarily halt output of the drive signal to the operating fluid discharging means in order to stop the exhaust valve closing operation temporarily when the time is reached; and calculate, on the basis of the rotation speed of the internal combustion engine, a time at which the piston arrives at the stopping position of the exhaust valve, and output the drive signal to the operating fluid discharging means in order to resume the exhaust valve closing operation before the arrival time.

12. The exhaust valve drive control device according to claim 11, wherein the control device repeats the stoppage and resumption of the exhaust valve closing operation until a displacement of the exhaust valve is equal to or less than a predetermined valve displacement on overlap condition at the time when the gap between the exhaust valve and the piston reaches the predetermined value, and when the displacement of the exhaust valve is equal to or less than the valve displacement on overlap condition at the time when the gap between the exhaust valve and the piston reaches the predetermined value, the control device temporarily halts output of the drive signal to the operating fluid discharging means in order to stop the exhaust valve closing operation temporarily at the point where the displacement of the exhaust valve matches the valve displacement on overlap condition, and then, when a crank angle of the internal combustion engine reaches a predetermined angle, outputs the drive signal to the operating fluid discharging means to close the exhaust valve to a fully closed position.

13. The exhaust valve drive control device according to claim 11, wherein the operating fluid discharging means comprise an operating valve for switching between discharging and halting the discharge of the operating fluid from the pressure chamber, whereby, during the exhaust valve closing operation, the control device outputs a drive signal to the operating valve to open the operating valve, and during the temporary stoppage of the exhaust valve closing operation, the control device halts output of the drive signal to the operating valve to fully close the operating valve.

14. The exhaust valve drive control device according to claim 12, wherein the operating fluid discharging means comprise an operating valve for switching between discharging and halting the discharge of the operating fluid from the pressure chamber, whereby, during the exhaust valve closing operation, the control device outputs a drive signal to the operating valve to open the operating valve, and during the temporary stoppage of the exhaust valve closing operation, the control device halts output of the drive signal to the operating valve to fully close the operating valve.

* * * * *

UNITED STATES PATENT AND TRADEMARK OFFICE

CERTIFICATE OF CORRECTION

PATENT NO. : 7,191,744 B2
APPLICATION NO. : 11/154415
DATED : March 20, 2007
INVENTOR(S) : Akihiko Minato It is certified that error appears in the above-identified patent and that said Letters Patent is hereby corrected as shown below:

Column 18, line 65, please delete the word "$V_{pistol}$" and replace with --$V_{piston}$--.

Signed and Sealed this

Twelfth Day of June, 2007

JON W. DUDAS
*Director of the United States Patent and Trademark Office*